US009064455B2

(12) United States Patent
Kim

(10) Patent No.: US 9,064,455 B2
(45) Date of Patent: Jun. 23, 2015

(54) DISPLAY DEVICE HAVING A POWER LINE ARRANGEMENT FOR REDUCING VOLTAGE DROP

(75) Inventor: Hyung-Soo Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 405 days.

(21) Appl. No.: 13/166,667

(22) Filed: Jun. 22, 2011

(65) Prior Publication Data

US 2012/0139959 A1 Jun. 7, 2012

(30) Foreign Application Priority Data

Dec. 6, 2010 (KR) ..... 10-2010-0123781

(51) Int. Cl.
*G09G 3/32* (2006.01)
*G09G 3/20* (2006.01)

(52) U.S. Cl.
CPC ..... *G09G 3/3233* (2013.01); *G09G 3/20* (2013.01); *G09G 2300/0426* (2013.01); *G09G 2300/0465* (2013.01); *G09G 2300/0842* (2013.01); *G09G 2320/0223* (2013.01); *G09G 2330/00* (2013.01)

(58) Field of Classification Search
CPC ..... G09G 3/3233; G09G 2300/0426; G09G 2300/0465; G09G 2320/0223; G09G 2330/00; H01L 27/3276
USPC ..... 345/76, 77, 211, 83
See application file for complete search history.

(56) References Cited

U.S. PATENT DOCUMENTS

| | | | | |
|---|---|---|---|---|
| 2002/0011976 | A1 | 1/2002 | Hashimoto | |
| 2003/0076046 | A1 | 4/2003 | Komiya et al. | |
| 2005/0162353 | A1 * | 7/2005 | Kanda | 345/76 |
| 2006/0139266 | A1 * | 6/2006 | Choi | 345/77 |
| 2010/0053042 | A1 * | 3/2010 | Kajiyama et al. | 345/76 |
| 2011/0128268 | A1 * | 6/2011 | Kim et al. | 345/211 |

FOREIGN PATENT DOCUMENTS

| | | | |
|---|---|---|---|
| CN | 1645445 | A | 7/2005 |
| CN | 1811884 | A | 8/2006 |
| EP | 1 557 815 | A2 | 7/2005 |
| EP | 1 675 095 | A2 | 6/2006 |
| JP | 2002-108252 | | 4/2002 |

(Continued)

OTHER PUBLICATIONS

SIPO Office action dated May 6, 2015, for corresponding Chinese Patent application 201110219880.8, (7 pages).

*Primary Examiner* — Allison Johnson
(74) *Attorney, Agent, or Firm* — Christie, Parker & Hale, LLP

(57) ABSTRACT

A display device includes: a pixel area comprising pixels in rows and columns; main power lines at a first side of the pixel area and a second side of the pixel area facing the first side; first sub-power lines coupled to a first main power line of the main power lines formed at the first side and extending into the pixel area in a column direction; and second sub-power lines coupled to a second main power line of the main power lines formed at the second side and extending into the pixel area in the column direction, wherein the first sub-power lines and the second sub-power lines extend in different columns of pixels, and wherein a column of pixels of the pixels are alternatingly coupled to a neighboring sub-power line of the first sub-power lines and a neighboring sub-power line of the second sub-power lines.

22 Claims, 4 Drawing Sheets

(56) References Cited

FOREIGN PATENT DOCUMENTS

| | | |
|---|---|---|
| JP | 2004-226543 | 8/2004 |
| JP | 2005-208346 | 8/2005 |
| JP | 2006-267766 | 10/2006 |
| JP | 2010-060648 | 3/2010 |
| JP | 2011-118341 | 6/2011 |
| KR | 10-2005-0067254 | 7/2005 |
| KR | 10-2008-0010873 | 1/2008 |

* cited by examiner

DISPLAY DEVICE HAVING A POWER LINE ARRANGEMENT FOR REDUCING VOLTAGE DROP

CROSS-REFERENCE TO RELATED APPLICATION

This application claims priority to and the benefit of Korean Patent Application No. 10-2010-0123781 filed in the Korean Intellectual Property Office on Dec. 6, 2010, the entire contents of which are incorporated herein by reference.

BACKGROUND

1. Field

Aspects of embodiments of the present invention relate to a display device.

2. Description of the Related Art

Various flat panel displays that have reduced weight and volume compared to cathode ray tubes have been developed. The types of flat panel displays includes liquid crystal displays (LCDs), a field emission displays (FEDs), plasma display panels (PDPs), and organic light emitting diode (OLED) displays.

A flat panel display generally includes a display panel including a plurality of pixels arranged in a matrix (or grid) format. The display panel includes a plurality of scan lines arranged in a row direction and a plurality of data lines arranged in a column direction, and the plurality of scan lines and the plurality of data lines cross each other. The plurality of pixels are driven by scan signals and data signals transmitted through the corresponding scan lines and data lines.

Flat panel displays may also be classified into passive matrix light emitting display devices and active matrix light emitting display devices according to a driving method thereof. Among the driving methods, the active matrix driving method, which selectively turns on/off the pixels, may be used for its advantages in resolution, contrast, and operation speed.

Generally, the active matrix type of light emitting display device may be driven with an analog driving method or a digital driving method. While it may be difficult to manufacture a driving integrated circuit (IC) for implementing the analog driving method for a large size and a high resolution panel, a simple IC structure may be used to realize the digital driving method for a high resolution panel. Also, the digital driving method has a characteristic of using an on-off state of a driving TFT (thin film transistor) such that it is seldom influenced by an image quality deterioration due to a TFT characteristic deviation inside the panel, thereby making it appropriate for a large sized panel. However, in the case of the digital driving method, cross-talk may be generated by a voltage drop (or IR-drop) in the power line. Particularly, crosstalk caused by the voltage drop of the power line may increase as the panel becomes larger.

The above information disclosed in this Background section is only for enhancement of understanding of the background of the invention and therefore it may contain information that does not form the prior art that is already known in this country to a person of ordinary skill in the art.

SUMMARY

Embodiments of the present invention provide a display device that reduces a decrease of an aperture ratio by a power line and that reduces crosstalk due to a voltage drop of a power line.

According to one embodiment of the present invention, a display device includes a pixel area comprising a plurality of pixels arranged in a plurality of rows and a plurality of columns; a plurality of main power lines formed at a first side of the pixel area and a second side of the pixel area facing the first side; a plurality of first sub-power lines coupled to a first main power line of the main power lines formed at the first side of the pixel area and extending into the pixel area in a column direction; and a plurality of second sub-power lines coupled to a second main power line of the main power lines formed at the second side of the pixel area and extending into the pixel area in the column direction, wherein the first sub-power lines and the second sub-power lines extend in different columns of pixels, and wherein a column of pixels of the pixels are alternatingly coupled to a neighboring sub-power line of the first sub-power lines and a neighboring sub-power line of the second sub-power lines.

The plurality of pixels may include a plurality of red pixels, a plurality of green pixels, and a plurality of blue pixels, wherein the plurality of pixels are arranged in a grid in which a pattern of a column of the plurality of red pixels, a column of the plurality of green pixels, and a column of the plurality of blue pixels is repeated across in the pixel area.

The first main power line may be a first line for supplying a first voltage of a power source to the plurality of red pixels, a second line for supplying a second voltage of the power source to the plurality of green pixels, or a third line for supplying a third voltage of the power source to the plurality of blue pixels.

The plurality of first sub-power lines may include a plurality of first sub-lines coupled to the first line, a plurality of second sub-lines coupled to the second line; or a plurality of third sub-lines coupled to the third line.

The display device may further include a plurality of first mesh power lines coupling the plurality of first sub-lines to one another, a plurality of second mesh power lines coupling the plurality of second sub-lines to one another, and a plurality of third mesh power lines coupling the plurality of third sub-lines to one another.

The plurality of first mesh power lines, the plurality of second mesh power lines, and the plurality of third mesh power lines may be electrically insulated from a plurality of wires coupling the plurality of pixels to the plurality of first sub-power lines or the plurality of second sub-power lines.

The second main power line may be: a first line for supplying a first voltage of the power source to the plurality of red pixels, a second line for supplying a second voltage of the power source to the plurality of green pixels, or a third line for supplying a third voltage of the power source to the plurality of blue pixels.

The plurality of second sub-power lines may include a plurality of first sub-lines coupled to the first line, a plurality of second sub-lines coupled to the second line, and a plurality of third sub-lines coupled to the third line.

The display device may further include a plurality of first mesh power lines coupling the plurality of first sub-lines to one another, a plurality of second mesh power lines coupling the plurality of second sub-lines to one another, and a plurality of third mesh power lines coupling the plurality of sub-lines to one another.

The plurality of first mesh power lines, the plurality of second mesh power lines, and the plurality of third mesh power lines may be electrically insulated from a wire connecting the plurality of pixels to the first sub-power line or the second sub-power line.

According to another embodiment of the present invention, a display device includes: a display unit including a plurality of pixels arranged in a plurality of rows and a plurality of columns; and a data driver configured to transmit a data voltage to the display unit by controlling an input time or a voltage level of the data voltage in accordance with a gray level of an image data signal, wherein the pixels included in one column of the columns among the plurality of pixels are alternatingly coupled to a first sub-power line of a plurality of first sub-power lines and a second sub-power line of a plurality of second sub-power lines, wherein the first sub-power line is connected to a first main power line located at a first side of the pixel area and extending along the one pixel column, and wherein the second sub-power line is connected to a second main power line located at a second side of the pixel area facing the first side and extending along another column of the columns adjacent to the one pixel column.

Each of the first sub-power lines and the second sub-power lines may extend along a different column of the columns.

The plurality of first sub-power lines and the plurality of second sub-power lines may be coupled together by a mesh power line.

The mesh power line may be electrically insulated from a wire coupling a pixel of the plurality of pixels to the first sub-power line or the second sub-power line.

The plurality of pixels may include a plurality of red pixels, a plurality of green pixels, and a plurality of blue pixels, wherein the one pixel column comprises the red pixels, the green pixels, or the blue pixels.

The first main power line may be: a first line for supplying a first voltage of a power source to the plurality of red pixels, a second line for supplying a second voltage of the power source to the plurality of green pixels, or a third line for supplying a third voltage of the power source to the plurality of blue pixels.

The first sub-power line may be a first sub-line coupled to the first line, a second sub-line coupled to the second line, or a third sub-line coupled to the third line.

The second main power line may be: a first line for supplying a first voltage of a power source to the plurality of red pixels, a second line for supplying a second voltage of the power source to the plurality of green pixels, or a third line for supplying a third voltage of the power source to the plurality of blue pixels.

The second sub-power line may be: a first sub-line coupled to the first line, a second sub-line coupled to the second line, or a third sub-line coupled to the third line.

According to embodiments of the present invention, a reduction of an aperture ratio by the power line supplying a power source voltage to a plurality of pixels may be reduced, and generation of crosstalk by a voltage drop of the power line may be reduced.

DETAILED DESCRIPTION

Figure 1:
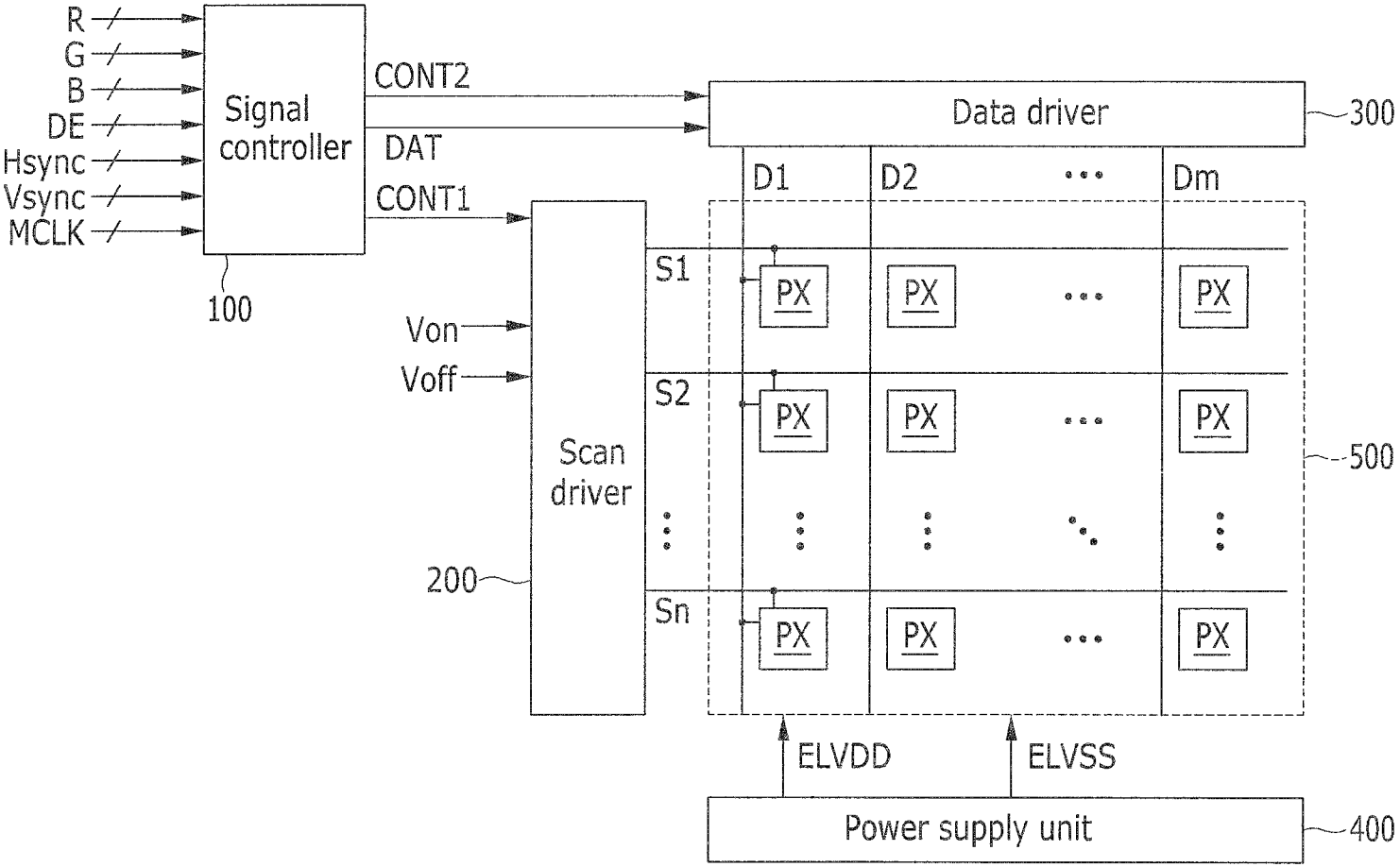
FIG. 1 is a block diagram of a display device according to one embodiment of the present invention.

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in the embodiments, like reference numerals designate like elements throughout the specification described in a first embodiment, and generally only elements that differ from than those of the first embodiment will be described in subsequent embodiments.

To improve clarity, parts that are not related to the description will be omitted.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to one embodiment of the present invention.

Referring to FIG. 1, a display device includes a signal controller 100, a scan driver 200, a data driver 300, a power supply unit 400, and a display unit 500.

The signal controller 100 receives a video signal (R, G, B) that is inputted (or supplied) from an external device and an input control signal that controls displaying thereof. The video signal (R, G, B) includes luminance information of each pixel PX, and the luminance has a gray level (e.g., a grayscale level) from among a plurality of gray levels (e.g., a plurality of predetermined gray levels or grayscale levels), for example $1024=2^{10}$ levels, $256=2^{8}$ levels, or $64=2^{6}$ levels. According to one embodiment of the present invention, the input control signal includes a vertical synchronization signal Vsync, a horizontal synchronization signal Hsync, a main clock signal MCLK, and a data enable signal DE.

According to one embodiment of the present invention, the signal controller 100 processes the input video signal (R, G, B) according to the operation condition of the display unit 500 and the data driver 300 on the basis of the input video signal (R, G, B) and the input control signal, and generates a scan control signal CONT1, a data control signal CONT2, and an image data signal DAT. The signal controller 100 transmits the scan control signal CONT1 to the scan driver 200. The signal controller 100 transmits the data control signal CONT2 and the image data signal DAT to the data driver 300.

The display unit 500 includes a plurality of scan lines S1-Sn, a plurality of data lines D1-Dm, and a plurality of pixels PX connected thereto and arranged in a matrix. The plurality of scan lines S1-Sn extend in a row direction and substantially parallel to each other, and the plurality of data lines D1-Dm extend in a column direction and substantially parallel to each other.

The scan driver 200 is connected to the plurality of scan lines S1-Sn and applies scan signals that include a combination of a gate on voltage Von that turns on a switching transistor (or switching transistors, see, e.g., M1 of FIG. 2) according to the scan control signal CONT1 and a gate off voltage Voff that turns off the switching transistor (or switching transistors) through the plurality of scan lines S1-Sn.

The data driver 300 is connected to the plurality of data lines D1-Dm and controls an input time or an input amount of a data voltage (or data voltages) according to gray levels of the image data signal DAT to transmit the data voltage (or data voltages) to the display unit 500. The data driver 300 applies the data voltage (or data voltages) to the plurality of data lines D1-Dm according to a data control signal CONT2.

The power supply unit 400 supplies a first power source voltage ELVDD and a second power source voltage ELVSS to a plurality of pixels PX included in the display unit 500.

Each driving device 100, 200, 300, and 400 may be directly mounted on the display unit 500 in the form of at least one integrated circuit chip mounted on a flexible printed circuit film and attached to the display unit 500 in the form of a tape carrier package (TCP) or mounted on a separate printed circuit board (PCB). The driving devices 100, 200, 300, and 400 may also be integrated in the display unit 500 together with the signal lines S1-Sn and D1-Dm.

The display device according to embodiments of the present invention may be operated by a digital driving method controlling the input time or the input amount of the data voltage input to the pixel PX according to the gray level of the image data signal DAT.

Figure 2:
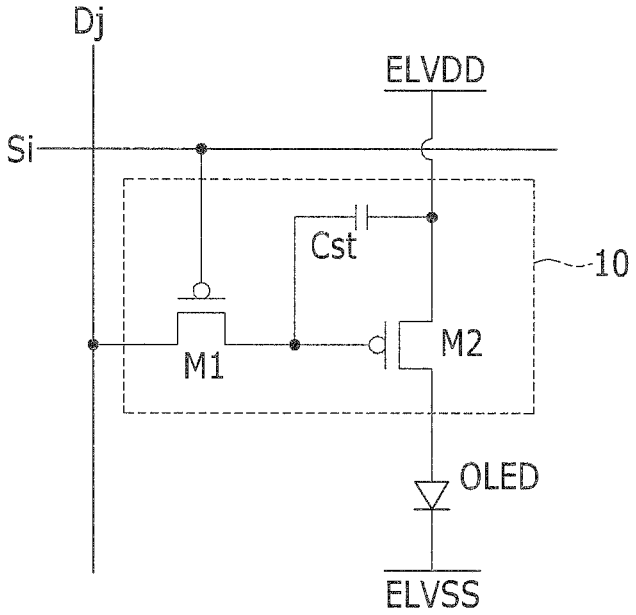
FIG. 2 is a circuit diagram of a pixel according to one embodiment of the present invention.

FIG. 2 is a circuit diagram of a pixel according to one embodiment of the present invention.

Referring to FIG. 2, according to one embodiment of the present invention, the pixel PX of the organic light emitting diode (OLED) display includes an organic light emitting diode (OLED) and a pixel circuit 10 to control the organic light emitting diode (OLED). The pixel circuit 10 includes a switching transistor M1, a driving transistor M2, and a sustain capacitor Cst.

The switching transistor M1 includes a gate electrode connected to the scan line Si, a first terminal connected to the data line Dj, and a second terminal connected to the gate electrode of the driving transistor M2.

The driving transistor M2 includes a gate electrode connected to the second terminal of the switching transistor M1, a first terminal connected to the power source ELVDD, and a second terminal connected to the anode of the organic light emitting diode (OLED).

The sustain capacitor Cst includes a first terminal connected to the gate electrode of the driving transistor M1 and a second terminal connected to the power source ELVDD. The sustain capacitor Cst charges (or stores) the data voltage applied to the gate electrode of the driving transistor M2 and maintains the data voltage after the switching transistor M1 is turned off.

The organic light emitting diode OLED includes an anode connected to the second terminal of the driving transistor M2 and a cathode connected to the power source ELVSS. The organic light emitting diode OLED can emit light of one color from a plurality of primary colors. For example, the organic light emitting diodes may be configured to emit light of three primary colors of red, green, and blue, and a desired color is displayed by a spatial or temporal sum of these three primary colors.

The switching transistor M1 and the driving transistor M2 may be p-channel field effect transistors. In one embodiment, the gate on voltage for turning on the switching transistor M1 and the driving transistor M2 is a low level voltage (e.g., a logic low signal), and the gate off voltage turning them off is a high level voltage (e.g., a logic high signal).

In one embodiment of the present invention, the switching transistor M1 and the driving transistor M2 are p-channel field effect transistors, however, in other embodiments of the present invention, at least one of the switching transistor M1 and the driving transistor M2 is an n-channel field effect transistor, and the gate on voltage for turning on the n-channel electric field effect transistor is a high voltage (e.g., the logic high voltage), and the gate off voltage for turning it off is a low voltage (e.g., the logic low voltage).

A method in which the display device according to one embodiment of the present invention is operated by the digital driving method will be described with reference to FIGS. 1 and 2.

The scan driver 200 applies the gate on voltage Von to the scan line Si in accordance with (or according to) the scan control signal CONT1 to turn on the switching transistor M1. In one embodiment, the data driver 300 applies the voltage of the logic high level (e.g., the gate off voltage) corresponding to a black display voltage of the organic light emitting diode (OLED) to the data line Dj. The driving transistor M2 is turned off, and the organic light emitting diode (OLED) deletes the previously input image data (e.g., the voltage stored in the capacitor Cst is reset) and displays black (e.g., the organic light emitting diode emits substantially no light).

Next, the scan driver 200 applies the gate on voltage Von to the scan line Si in accordance with (or according to) the scan control signal CONT1 during one period (e.g., a horizontal period or a predetermined period) to turn on the switching transistor M1. One period may be referred to as 1H and has the same length in time as the horizontal synchronization signal Hsync and the data enable signal DE. Here, the data driver 300 applies the data voltage of the logic low level (e.g., the gate on voltage) to the data line Dj according to the data control signal CONT2. The sustain capacitor Cst is charged by (or stores) the data voltage, and the driving transistor M2 may be turned on in accordance with the stored data voltage. The voltage of the power source ELVDD is transmitted to the anode of the organic light emitting diode (OLED) through the turned on driving transistor M2 during one time period.

The process in which the voltage of the power source ELVDD is transmitted to the anode of the organic light emitting diode (OLED) is repeated according to the gray level of the image data signal DAT during one frame. For example, if the portion of the power source voltage ELVDD that is applied to the anode of the organic light emitting diode (OLED) is increased (e.g., when the driving transistor M2 is controlled by the stored voltage such that the voltage drop between the first and second terminals of the driving transistor M2 is low), the amount of light emitted by the organic light emitting diode (OLED) is increased and the image data signal DAT of the high gray level may be expressed. That is, the display device inputs a voltage of the power source ELVDD light-emitting the organic light emitting diode (OLED) in an amount (e.g., a number of times or for an amount of time) corresponding to the gray level of the image data signal DAT to express the gray level of the image data signal DAT.

The above-described digital driving method is one embodiment of various digital driving methods, and embodiments of the present invention are not limited thereto. Also, in other embodiments of the present invention, the structure of the pixel may be different, and the digital driving method may be changed in accordance with the structure of the pixel.

As described above, the gray level of the image data signal DAT is expressed according to the voltage or the amount of time that the power source ELVDD having a voltage (or a predetermined voltage level) is transmitted to the anode of the organic light emitting diode (OLED) in the digital driving method, however if the voltage level of the power source ELVDD that is transmitted to the anode of the organic light emitting diode (OLED) is not uniform, image quality deterioration such as crosstalk may be generated. If the panel of the display device is large, the length of the power line transmitting the power source voltage ELVDD to the pixel in the power supply unit 400 is increased such that a voltage drop is generated in the power line, and resultantly the voltage of the power source ELVDD may not be transmitted at a substantially constant level to the plurality of pixels.

Next, a wire structure of a power line of the display device capable of reducing the voltage drop (or IR drop) in the power line and transmitting the voltage of the power source ELVDD at a substantially constant level to the plurality of pixels will be described in more detail.

Figure 3:
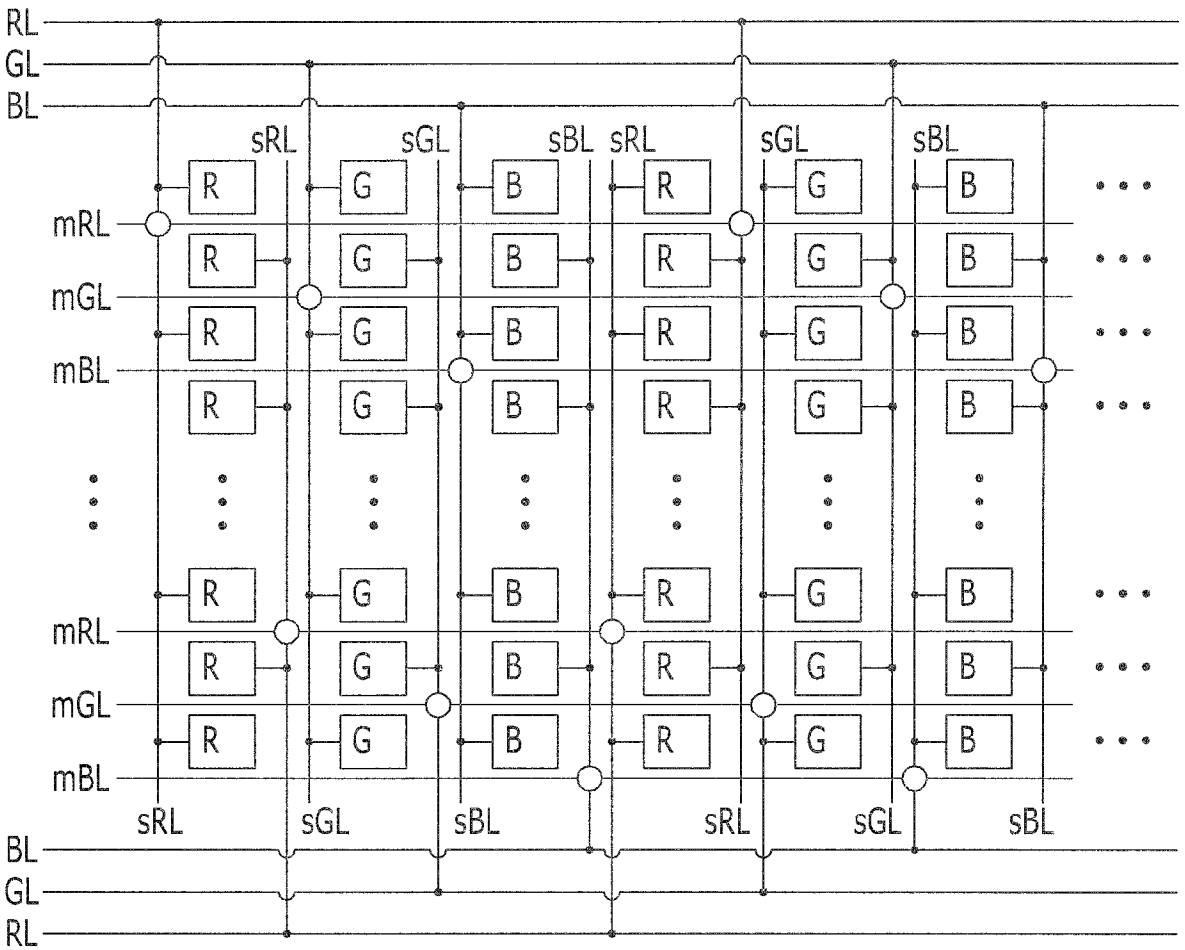
FIG. 3 is a view showing a wire structure of a power line of a display device configured to be driven by a digital driving method according to one embodiment of the present invention.

FIG. 3 is a view showing one example of a wire structure of a power line of a display device driven by a digital driving method according to one embodiment of the present invention.

Referring to FIG. 3, according to one embodiment of the present invention, a plurality of pixels include a red pixel R having an organic light emitting diode (OLED) configured to emit red light, a green pixel G having an organic light emitting diode (OLED) configured to emit green light, and a blue pixel B having an organic light emitting diode (OLED) configured to emit blue light. A plurality of pixels are arranged in a matrix in which an arrangement of a plurality of red pixels R, a plurality of green pixels G, and a plurality of blue pixels B are repeated line by line in the pixel area in which the plurality of pixels are disposed.

Main power lines RL, GL, and BL are disposed at two sides corresponding to one side surface in the pixel area. The main power lines RL, GL, and BL include a red line RL, a green line GL, and a blue line BL in accordance with the light emitting color of the organic light emitting diode (OLED) that each line is coupled to. The luminous efficiency of the organic light emitting diode (OLED) is different according to the light emitting color, and the line width of the main power lines RL, GL, and BL is different according to the luminous efficiency. Further, because the luminous efficiency of the organic light emitting diode (OLED) is different for organic light emitting diodes designed to emit different colors, different power source voltages may be applied. Accordingly, the main power lines RL, GL, and BL are formed corresponding to the light emitting color of the organic light emitting diodes (OLEDs) to which they are coupled, and the red pixels R, the green pixels G, the blue pixels B independently receive different voltages from the power source (or receive power from different power sources).

A plurality of red sub-power lines sRL extend from the red line RL on a first side and a second plurality of red sub-power lines sRL extend from the red line RL on a second side along the column of the red pixel R. The plurality of red sub-power lines sRL extending in the column direction of the red pixel R from the red line RL on the first side are not connected to the red line RL the second side, and the plurality of red sub-power lines sRL extending in the column direction of the red pixel R from the red line RL of the second side are not connected to the red line RL of the first side. Among the red pixels R in one column, the red pixels R in odd numbered rows are connected to the red sub-power line sRL connected to the red line RL on the first side, and the even-numbered red pixels R are connected to the red sub-power line sRL connected to the red line RL on the second side.

A plurality of green pixels G are connected to the green line GL through a plurality of green sub-power lines sGL and a plurality of blue pixels B are connected to the blue line BL through a plurality of blue sub-power lines sBL in a manner substantially the same as the manner in which the plurality of red pixels R are connected to the red line RL.

As described above, two sub-power lines (e.g., sRL) extending from the main power line (e.g., RL) on a first side and the main power line on the second side are supply power for one column of pixels. This structure may be used to reduce the voltage drop along the power line due to the increasing of the length of the sub-power lines connected to the pixel from the main power lines RL, GL, and BL.

Also, to further reduce the voltage drop along the power line, mesh power lines mRL, mGL, and mBL coupled to the plurality of sub-power lines sRL, sGL, and sBL extending from the main power lines RL, GL, and BL may be further provided to provide a mesh structure. For example, a plurality of red sub-power lines sRL extending from the red line R in a column direction are connected to the plurality of red mesh power lines mRL extending in a row direction. Here, the red mesh power line mRL is only connected to a plurality of red sub-power lines extending from one side among a plurality of red sub-power lines extended from the red line of the first side and a plurality of red sub-power lines extended from the red line of the second side.

A plurality of green sub-power lines sRL and a plurality of green mesh power lines mGL are connected together and a plurality of blue sub-power lines sBL and a plurality of blue mesh power lines mBL are connected together in a manner substantially the same as the manner in which the plurality of red sub-power lines sRL and a plurality of red mesh power lines mRL are connected together. Here, the point where the sub-power lines sRL, sGL, and sBL and the mesh power lines mRL, mGL, and mBL are connected is represented as a white circle.

As described above, according to one embodiment of the present invention, the wire structure of the power line supplying the power source voltage to a plurality of pixels may be formed with a mesh structure in which a plurality of sub-power lines sRL, sGL, and sBL extending in the column direction and a plurality of mesh power lines mRL, mGL, and mBL extending in the row direction are connected. The wire structure of the power lines may further reduce the voltage drop of the power line.

However, as the wire number of a plurality of sub-power lines sRL, sGL, and sBL and a plurality of mesh power lines mRL, mGL, and mBL is increased in the pixel area, the aperture ratio may be reduced by the wire, and the thickness of the wire may need to be reduced such that the RC delay may be increased. Particularly, when two sub-power lines are formed for one pixel column, the aperture ratio may be largely influenced, and the RC delay may occur.

Figure 4:
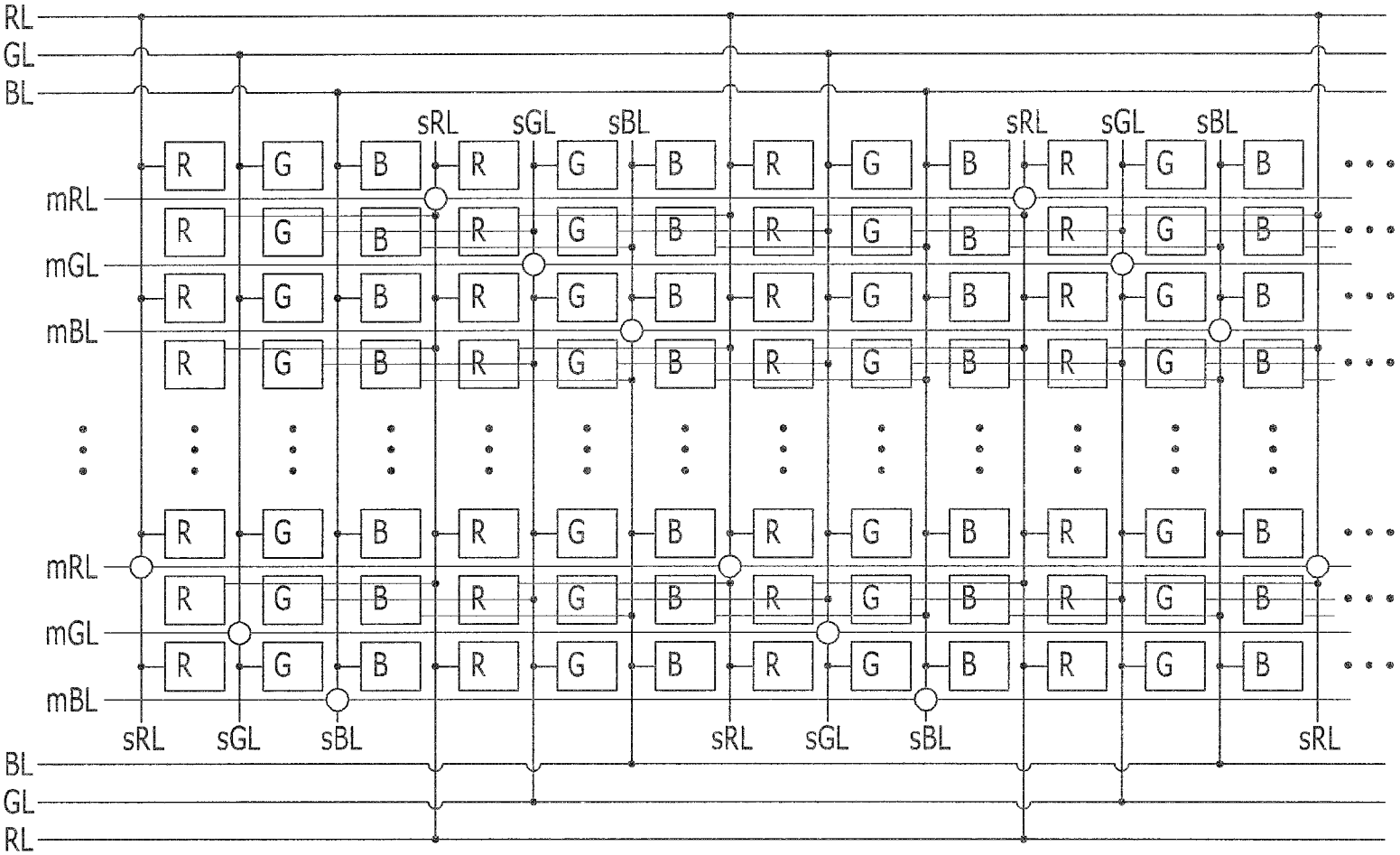
FIG. 4 is a view showing a wire structure of a power line of a display device configured to be driven by a digital driving method according to another embodiment of the present invention.

FIG. 4 is a view showing a wire structure of a power line of a display device driven by a digital driving method according to one embodiment of the present invention.

Referring to FIG. 4, a plurality of pixels include a plurality of red pixels R, a plurality of green pixels G, and a plurality of blue pixels B. The plurality of pixels are arranged in a matrix form in which a plurality of red pixels R, a plurality of green pixels G, and a plurality of blue pixels B are repeated line by line in the pixel area.

The power line includes main power lines RL, GL, and BL formed at a first side and a second side facing the first side of pixel area, a plurality of sub-power lines sRL, sGL, and sBL connected to the main power lines RL, GL, and BL and extending into the pixel area (e.g., in a column direction), and a plurality of mesh power lines mRL, mGL, and mBL connected to a plurality of sub-power lines sRL, sGL, and sBL (e.g., extending in a row direction) and formed with a mesh shape.

The main power lines RL, GL, and BL are disposed at the first side of the pixel area and the second side of the pixel area facing the first side. The main power lines RL, GL, and BL include a red line RL supplying the voltage of the power source to a plurality of red pixels R, a green line GL supplying the voltage of the power source to a plurality of green pixel G, and a blue line BL supplying the voltage of the power source to a plurality of blue pixels B such that each of the red, blue, and green main power lines RL, BL, and GL supplies power to a pixel corresponding to the light emitting color of the organic light emitting diode (OLED).

A plurality of sub-power lines sRL, sGL, and sBL include a plurality of first sub-power lines connected to the main power line of the first side and extending into the pixel area, and a plurality of second sub-power lines connected to the main power line of the second side and extending into the pixel area. A plurality of the first sub-power lines and a plurality of the second sub-power lines respectively include a plurality of red sub-power lines sRL connected to the red line RL, a plurality of green sub-power lines sGL connected to the green line GL, and a plurality of blue sub-power lines sBL connected to the blue line BL. The number of plurality of sub-power lines sRL, sGL, and sBL corresponds to the number of pixel columns, and one sub-power line is connected from the main power lines RL, GL, and BL from the first side or the second side for each pixel column. That is, a plurality of the first sub-power lines and a plurality of the second sub-power lines are extended along the column direction for different pixel columns.

For example, the first red sub-power line sRL connected to the red line RL of the first side extends along one column of red pixels, and the second red sub-power line sRL connected to the red line RL of the second side extends along another column of red pixels. The green sub-power line and the blue sub-power line are formed in a manner substantially the same as the manner in which the red sub-power lines sRL are formed.

A plurality of pixels included in one pixel column are alternatingly connected to the first sub-power line and the second sub-power line. For example, the red pixels R of one column are alternatingly connected to the red sub-power line sRL extending along to the corresponding one column of red pixels R and the red sub-power line sRL extending along an adjacent column of red pixels R. For example, the red pixels in odd numbered rows among the red pixels R of one column are connected to the red sub-power line extending along the one column of red pixels, and the even-numbered red pixels are connected to the red sub-power line extending along another column of red pixels adjacent thereto (e.g., with a column of green pixels and a column of blue pixels between the adjacent columns of red pixels).

A plurality of green pixels G are connected to the green line GL through a plurality of green sub-power lines sGL and a plurality of blue pixels B are connected to the blue line BL through a plurality of blue sub-power lines sBL in a manner substantially the same as the manner in which the plurality of red pixels R are connected to the red line RL.

A plurality of mesh power lines mRL, mGL, and mBL are connected together with a plurality of sub-power lines sRL, sGL, and sBL extending from the same main power lines RL, GL, and BL to form a mesh wire structure. That is, the mesh power lines mRL, mGL, and mBL connect a plurality of the first sub-power lines and a plurality of the second sub-power lines to each other in the pixel area. For example, a plurality of mesh power lines mRL, mGL, and mBL respectively connect a plurality of red sub-power lines to one another, a plurality of green sub-power lines to one another, and a plurality of blue sub-power lines to one another. Also, a plurality of mesh power lines mRL, mGL, and mBL respectively connect a plurality of red sub-power lines, a plurality of green sub-power lines, and a plurality of blue sub-power lines included in the second sub-power line to each other.

The mesh power lines mRL, mGL, and mBL may be connected to a plurality of sub-power lines sRL, sGL, and sBL without connecting to pixels or sub-power lines in adjacent columns corresponding to different color pixels. Locations where the sub-power lines sRL, sGL, and sBL and the mesh power lines mRL, mGL, and mBL are connected are indicated with white circles.

For example, a plurality of red mesh power lines mRL extend in the row direction and are connected to a plurality of red sub-power lines extending from the red line of the first side or a plurality of red sub-power lines extending from the red line of the second side. A plurality of green mesh power lines mGL extend in the row direction and are connected to a plurality of green sub-power lines extending from the green line of the first side or a plurality of green sub-power lines extending from the green line of the second side. A plurality of blue mesh power lines mBL extend in the row direction and are connected to a plurality of blue sub-power lines extending from the blue line of the first side or a plurality of blue sub-power lines extending from the blue line of the second side.

The plurality of mesh power lines mRL, mGL, and mBL may be supplied with a power source voltage applied to the main power line RL, GL, and BL or a voltage (e.g., a predetermined voltage) to compensate for the voltage drop in the power line. If a plurality of mesh power lines mRL, mGL, and mBL are applied with the voltage of the power source or the voltage (e.g., the predetermined voltage), the voltage drop in the power line may be further reduced.

As described above, one sub-power line extending from the main power line of the first side or the main power line of the second side is formed for one column of pixels and the pixels included in the one column are alternatingly connected to the sub-power line extended along the corresponding column of pixels and the sub-power line extending along the adjacent pixel column of the same color, and the aperture ratio may thereby be improved compared with the wire structure of FIG. 3, the voltage drop in the power line may be reduced, and the crosstalk according to the voltage drop may be compensated for.

The drawings and the detailed description described above are embodiments of the present invention and are provided to explain the present invention, and the scope of the present invention described in the claims is not limited thereto. Therefore, it will be appreciated to those skilled in the art that various modifications may be made and other equivalent embodiments are available. Accordingly, the actual scope of the present invention must be determined by the spirit of the appended claims and equivalents thereof.

DESCRIPTION OF SOME OF THE REFERENCE NUMERALS IN THE FIGURES

100: signal controller
200: scan driver
300: data driver
400: power supply unit
500: display unit

What is claimed is:

1. A display device comprising:

a pixel area comprising a plurality of pixels arranged in a plurality of rows and a plurality of columns;

a plurality of main power lines formed at a first side of the pixel area and a second side of the pixel area facing the first side;

a plurality of first sub-power lines coupled to a first main power line of the main power lines formed at the first side of the pixel area and extending into the pixel area in a column direction; and a plurality of second sub-power lines coupled to a second main power line of the main power lines formed at the second side of the pixel area and extending into the pixel area in the column direction, the second main power line being configured to supply a same voltage as the first main power line, wherein the plurality of first sub-power lines are not directly coupled to the second main power line, wherein the first sub-power lines and the second sub-power lines extend between different columns of pixels, and wherein a column of pixels of the pixels are alternatingly coupled to a neighboring sub-power line of the first sub-power lines and a neighboring sub-power line of the second sub-power lines.

2. The display device of claim 1, wherein the plurality of pixels comprise:

a plurality of red pixels;

a plurality of green pixels; and a plurality of blue pixels, and wherein the plurality of pixels are arranged in a grid in which a pattern of a column of the plurality of red pixels, a column of the plurality of green pixels, and a column of the plurality of blue pixels is repeated across the pixel area.

3. The display device of claim 2, wherein the first main power line is:

a first line for supplying a first voltage of a power source to the plurality of red pixels;

a second line for supplying a second voltage of the power source to the plurality of green pixels; or a third line for supplying a third voltage of the power source to the plurality of blue pixels.

4. The display device of claim 3, wherein the plurality of first sub-power lines comprises:

a plurality of first sub-lines coupled to the first line;

a plurality of second sub-lines coupled to the second line; and a plurality of third sub-lines coupled to the third line.

5. The display device of claim 4, further comprising:

a plurality of first mesh power lines coupling the plurality of first sub-lines to one another;

a plurality of second mesh power lines coupling the plurality of second sub-lines to one another; and a plurality of third mesh power lines coupling the plurality of third sub-lines to one another.

6. The display device of claim 5, wherein the plurality of first mesh power lines, the plurality of second mesh power lines, and the plurality of third mesh power lines are electrically insulated from a plurality of wires coupling the plurality of pixels to the plurality of first sub-power lines or the plurality of second sub-power lines.

7. The display device of claim 2, wherein the second main power line is:

a first line for supplying a first voltage of a power source to the plurality of red pixels, a second line for supplying a second voltage of the power source to the plurality of green pixels, or a third line for supplying a third voltage of the power source to the plurality of blue pixels.

8. The display device of claim 7, wherein the plurality of second sub-power lines comprises:

a plurality of first sub-lines coupled to the first line;

a plurality of second sub-lines coupled to the second line; and a plurality of third sub-lines coupled to the third line.

9. The display device of claim 8, further comprising:

a plurality of first mesh power lines coupling the plurality of first sub-lines to one another;

a plurality of second mesh power lines coupling the plurality of second sub-lines to one another; and a plurality of third mesh power lines coupling the plurality of third sub-lines to one another.

10. The display device of claim 9, wherein the plurality of first mesh power lines, the plurality of second mesh power lines, and the plurality of third mesh power lines are electrically insulated from a wire coupling a pixel of the plurality of pixels to the first sub-power line or the second sub-power line.

11. The display device of claim 1, wherein the column of pixels is a single column of pixels, and wherein the neighboring sub-power line of the first sub-power lines and the neighboring sub-power line of the second sub-power lines are directly coupled exclusively to the column of pixels.

12. The display device of claim 1, wherein the first sub-power line coupled to the column of pixels is adjacent to the column of pixels and the second sub-power line coupled to the column of pixels is adjacent to a third column of pixels, wherein a second column of pixels is located between the column of pixels and the third column of pixels.

13. A display device comprising:

a display unit comprising a plurality of pixels arranged in a plurality of rows and a plurality of columns to form a pixel area; and a data driver configured to transmit a data voltage to the display unit by controlling an input time or a voltage level of the data voltage in accordance with a gray level of an image data signal, wherein the pixels included in one column of the columns among the plurality of pixels are alternatingly coupled to a first sub-power line of a plurality of first sub-power lines and a second sub-power line of a plurality of second sub-power lines, wherein the first sub-power line is connected to a first main power line located at a first side of the pixel area and extending along the one column, wherein the second sub-power line is connected to a second main power line located at a second side of the pixel area facing the first side and extending along another column of the columns adjacent to the one column, the second main power line being configured to supply a same voltage as the first main power line, and wherein the first sub-power line is not directly connected to the second main power line.

14. The display device of claim 13, wherein each of the first sub-power lines and the second sub-power lines extends along a different column of the columns.

15. The display device of claim 14, wherein the plurality of first sub-power lines and the plurality of second sub-power lines are coupled together by a mesh power line.

16. The display device of claim 15, wherein the mesh power line is electrically insulated from a wire coupling a pixel of the plurality of pixels to the first sub-power line or the second sub-power line.

17. The display device of claim 13, wherein the plurality of pixels comprises:

a plurality of red pixels;

a plurality of green pixels; and a plurality of blue pixels, wherein the one column comprises the red pixels, the green pixels, or the blue pixels.

18. The display device of claim 17, wherein the first main power line is:

a first line for supplying a first voltage of a power source to the plurality of red pixels, a second line for supplying a second voltage of the power source to the plurality of green pixels, or a third line for supplying a third voltage of the power source to the plurality of blue pixels.

19. The display device of claim 18, wherein the first sub-power line is:

a first sub-line coupled to the first line, a second sub-line coupled to the second line, or a third sub-line coupled to the third line.

20. The display device of claim 17, wherein the second main power line is:

a first line for supplying a first voltage of a power source to the plurality of red pixels, a second line for supplying a second voltage of the power source to the plurality of green pixels, or a third line for supplying a third voltage of the power source to the plurality of blue pixels.

21. The display device of claim 20, wherein the second sub-power line is:

a first sub-line coupled to the first line, a second sub-line coupled to the second line, or a third sub-line coupled to the third line.

22. The display device of claim 13, wherein the first sub-power line and the second sub-power line are directly coupled exclusively to the one column of pixels.

* * * * *